US005907962A

United States Patent [19]

Smithson et al.

[11] Patent Number: 5,907,962

[45] Date of Patent: Jun. 1, 1999

[54] LATCHING ASSEMBLY FOR A COMPUTER

[75] Inventors: Steve Smithson, Redwood City; Steve Dean, Sunnyvale, both of Calif.

[73] Assignee: Silicon Graphics, Inc., Mountain View, Calif.

[21] Appl. No.: 08/966,611

[22] Filed: Nov. 10, 1997

[51] Int. Cl.[6] ..... E05B 69/00

[52] U.S. Cl. ..... 70/58; 70/14; 70/164

[58] Field of Search ..... 70/426, 428, 14, 70/58, 158, 164; 30/254; 81/416

[56] References Cited

U.S. PATENT DOCUMENTS

| | | | |
|---|---|---|---|
| 934,928 | 9/1909 | Michel | 70/426 |
| 3,982,450 | 9/1976 | Marsh | 81/416 |
| 4,738,428 | 4/1988 | Themistos et al. | 70/58 |
| 5,197,879 | 3/1993 | Fowler, III et al. | 81/416 |
| 5,390,514 | 2/1995 | Harmon | 70/14 |
| 5,400,622 | 3/1995 | Harmon | 70/58 |
| 5,446,618 | 8/1995 | Tetsuya et al. | 70/58 |
| 5,722,268 | 3/1998 | Choi | 70/58 |

FOREIGN PATENT DOCUMENTS

| | | | |
|---|---|---|---|
| 1085107 | 6/1953 | France | 70/14 |
| 14095 | 11/1904 | Norway | 70/424 |

OTHER PUBLICATIONS

Kensington Advertisement, Apr. 23, 1992.

*Primary Examiner*—Darnell M. Boucher
*Attorney, Agent, or Firm*—Wagner, Murabito & Hao

[57] ABSTRACT

A computer which includes a computer chassis and a door is disclosed. The chassis includes a slot and the door includes a corresponding slot which are aligned when the door is in the closed position so as to create an opening which extends through the chassis and through the door. A tab assembly is inserted into the opening. The tab assembly includes two tabs which are coupled together such that the tabs may move laterally with respect to each other. The tabs may be moved into an extended position such that they latch the door to the chassis. A padlock may then be inserted into an opening within the tab assembly so as to lock the tab assembly in the extended position and thereby lock the door to the chassis.

5 Claims, 10 Drawing Sheets

LATCHING ASSEMBLY FOR A COMPUTER

TECHNICAL FIELD

The present claimed invention relates to the field of attachment mechanisms. More specifically, the present claimed invention relates to an improved attachment mechanism for attaching a door to a chassis of a computing device.

BACKGROUND ART

Prior art methods for securing a door to a computer chassis involve the use of screws which engage openings in the door and corresponding openings in the computer chassis. The use of screws means that a screwdriver is required to remove the door. The process of removing multiple screws takes time. Furthermore, screws are not desirable as they are difficult to manage and they require a tool to insert and remove. In addition, screws take a significant amount of time to put in and remove and they can be easily lost.

It is desirable to limit a user's access to the internal components of the computer. This prevents an unauthorized operator from opening the computer door and accessing internal components of the computer and possibly damaging the computer or add-on components located within the computer chassis. In addition, by restricting unauthorized access to the internal components of the computer, theft of hardware is prevented.

One type of prior art device, includes a hinged access panel which locks using projecting flanges which are engaged by a padlock. The access panel is typically attached to the left or right side of the chassis and the access panel pivots away from the main computer for access to internal hardware and components. Matching projecting flanges, one located on the door and one located on the chassis, include openings which receive a padlock.

However, designs which use projecting flanges require that a flange be formed in the door and that a second flange be formed in the chassis. Typically, the door flange is formed by bending a detail which includes an opening such that the detail projects as required to mate with the corresponding flange in the chassis. Typically, the flange of the chassis is also made by forming a detail within the structure of the chassis and bending the detail. Thus, designs which use projecting flanges are expensive since the detail must first be machined into the chassis and bent into the proper shape. In addition, forming the flange on the door is expensive since the detail must first be machined into the door and bent into the proper shape.

Alternate manufacturing methods involve the welding of flanges onto the door and onto the chassis. This is also expensive since the parts must be manufactured separately, precisely aligned, and separately welded.

One recent prior art method for preventing unauthorized access to components located within a chassis involves locking a door that attaches to the chassis using a metal L-shaped bar. The L-shaped bar is inserted into an opening in the front of the chassis. The bar extends through an opening in the back of the chassis. A projecting flange extends from the chassis. The projecting flange has an opening that corresponds to an opening in the bar so as to allow a padlock to be inserted through the opening in the flange and through the opening in the L-shaped bar in the back of the computer. Once the end of the L-shaped bar is locked, the door may not be removed since the other end of the bar extends across the front of the door.

Latching mechanisms that use an L-shaped bar to secure a door that is located on the front of the computer are difficult to operate since the user must first get behind the computer to unlock the padlock. Next the user must move around to the front of the computer and remove the L-shaped bar. Then the door may be opened or removed as dictated by the design of the system. Numerous steps are required to open this type of latching mechanism and the process takes a significant amount of time. Furthermore, this type of design may confuse users since the door is on the front of the computer and the lock is in the back of the computer. This can be confusing to users that want to open the door because they can see the mechanism for opening the door but they cannot readily see the locking mechanism unless they look behind the computer. Thus, users who attempt to open the door typically think that the door is simply stuck, and they may try to force the door open, causing unplanned damage to the door and to the latching mechanism.

What is needed is a latching mechanism which will secure a door to a chassis and which is easy to operate and easy to lock and unlock. In addition, a latching mechanism which is inexpensive to manufacture and install is required. Moreover, a latching mechanism will give the user feedback with regard to whether or not the mechanism is locked is required. The present invention provides an elegant solution that meets the above needs.

DISCLOSURE OF THE INVENTION

The present invention meets the above needs with a latching mechanism which secures a door to a computer chassis. The latching mechanism includes corresponding slots formed in the door and in the chassis and a tab assembly which engages the slots so as to latch the door to the chassis.

A computer which includes a chassis is disclosed. A door is attached to the side of the computer so as to allow access to the internal components of the computer. The door and the chassis form a housing which encloses the electronic components of the computer. The door is coupled to the chassis such that the door may be opened and closed. In one embodiment the door is attached to the chassis by a hinge which allows the door to easily move between a closed position and an open position.

In one embodiment of the present invention the chassis of the computer includes a slot and the door includes a corresponding slot. The slot on the chassis and the slot on the door are located such that, when the door is in the closed position the slot in the door aligns with the slot in the chassis to create an opening which extends through the chassis and through the door.

The tab assembly includes two tabs which are joined at an attachment region such that the tabs may move laterally within a predetermined range. Both tabs have a head region and a body region. Both tabs also include a lock opening which extends through the head region of the tabs. The lateral movement of the tabs allows the tabs to be moved from a closed position to an extended position. The lock openings of the two tabs are located such that, upon the movement of the tabs into the extended position, the lock openings are aligned. This creates an opening which extends through both tabs.

In one embodiment the attachment region of both tabs includes a pivot lock which extends from each of the tabs and a pivot opening disposed such that the tabs may be mated by inserting the pivot lock of one tab into the pivot opening of the other tab such that each pivot tab engages a corresponding pivot opening. This allows the two tabs to pivot within a limited range once they are assembled together.

The tab assembly may be moved into a closed position which aligns the body regions of each of the tabs such that the body regions may be inserted into the opening formed by the slots in the chassis and in the door. The tab assembly may then be extended laterally into the extended position. In the extended position the tab assembly engages the door and the chassis so as to latch the door to the chassis. In the extended position, the lock openings are aligned so as to create an opening which extends through both tabs. A standard padlock is then inserted into the opening so as to hold the tabs in the extended position. This securely locks the door to the chassis. The locking of the door to the chassis prevents access to the internal components of the computer by unauthorized users.

In one embodiment the two tabs are identical. This makes manufacture of the tabs inexpensive, and consequently makes the manufacture of the tab assembly inexpensive.

The present invention allows for easily securing the door to the chassis as there are no screws to screw in, keep up with, and screw out. In addition, no special tools such as a screwdriver are needed. Furthermore, the mechanism is easy to operate and is reliable. In addition, the tab assembly is inexpensive to manufacture and assemble. Thus, the present invention provides a simple and elegant solution to the problems associated with prior art attachment mechanisms.

These and other objects and advantages of the present invention will no doubt become obvious to those of ordinary skill in the art after having read the following detailed description of the preferred embodiments which are illustrated in the various drawing figures.

BRIEF DESCRIPTION OF THE DRAWINGS

The accompanying drawings, which are incorporated in and form a part of this specification, illustrate embodiments of the invention and, together with the description, serve to explain the principles of the invention.

BEST MODE FOR CARRYING OUT THE INVENTION

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be obvious to one of ordinary skill in the art that the present invention may be practiced without these specific details. In other instances, well known methods, procedures, components, and circuits have not been described in detail as not to unnecessarily obscure aspects of the present invention.

Figure 1:
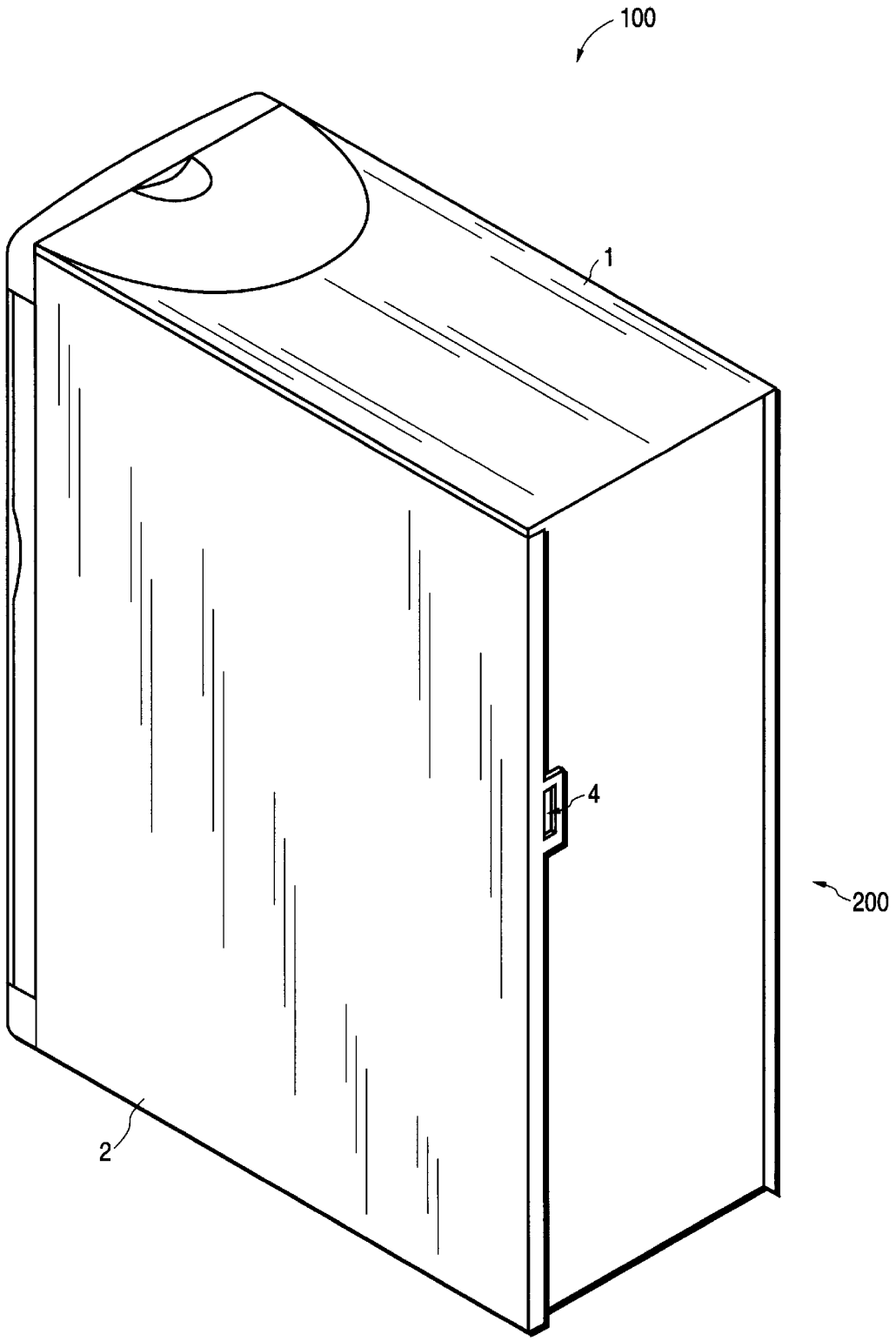
FIG. 1 is a perspective view of a computer having a door which is closed in accordance with the present invention.

With reference now to FIG. 1, the housing of computer 100 is shown to include a chassis 1 and door 2. Chassis 1 encloses the top, the bottom, and three sides of computer 100. Door 2 encloses one side of Computer 100. Door 2 is shown to be closed. In the closed position, door 2 encloses the electronic components of computer 100. Latching mechanism 200 includes slot 4 which extends through door 2.

Figure 2:
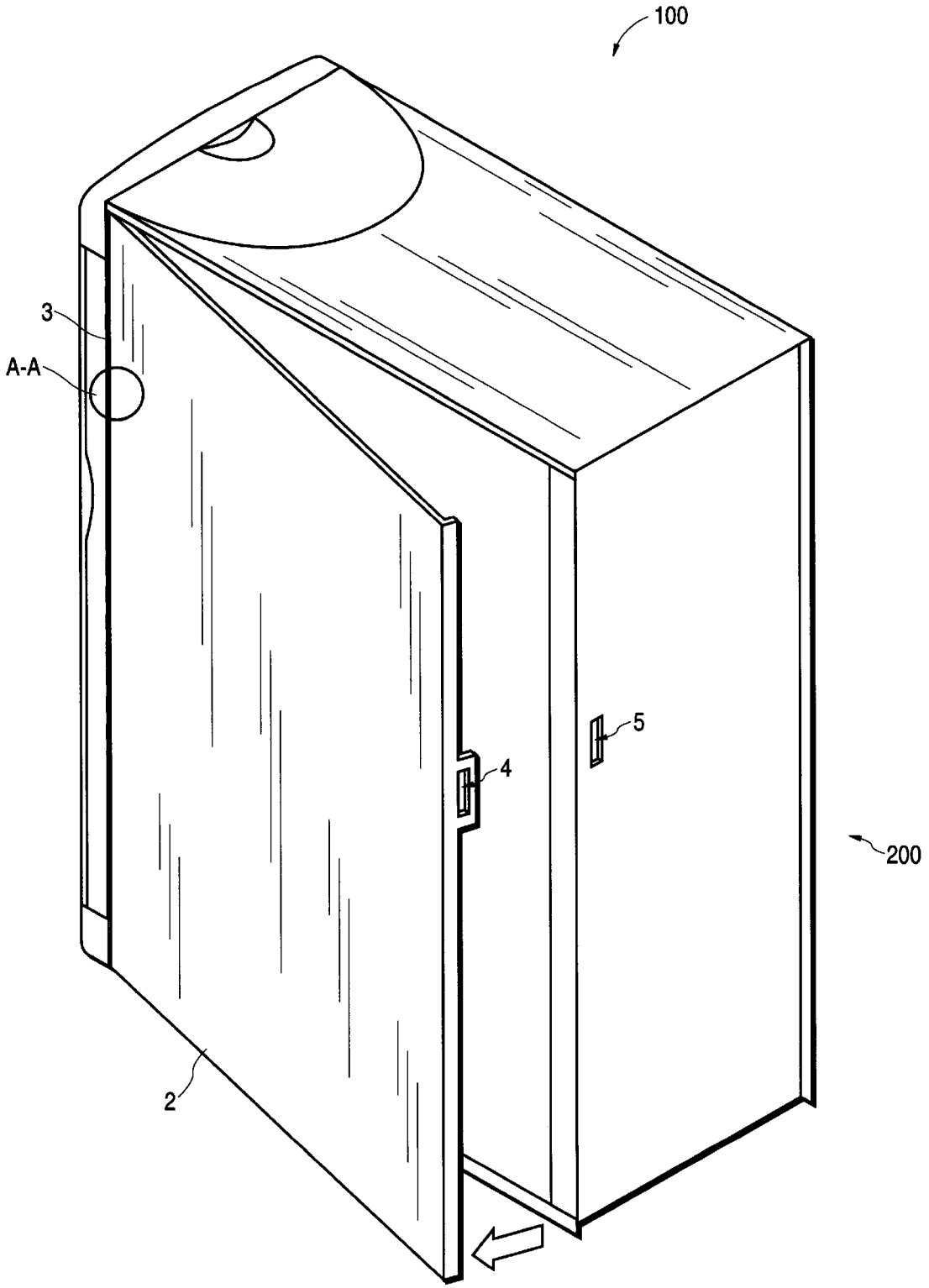
FIG. 2 is a perspective view of a computer having a door which is open in accordance with the present invention.

As shown in FIG. 2, door 2 swings on hinge 3 so as to open. In the open position, a user has access to the electronic components located within chassis 1 of computer 100. Latching mechanism 200 includes slot 5 which extends through chassis 1. Slot 5 is aligned with slot 4 such that, when door 2 is closed, an opening extends through both door 2 and chassis 1.

Figure 2A:
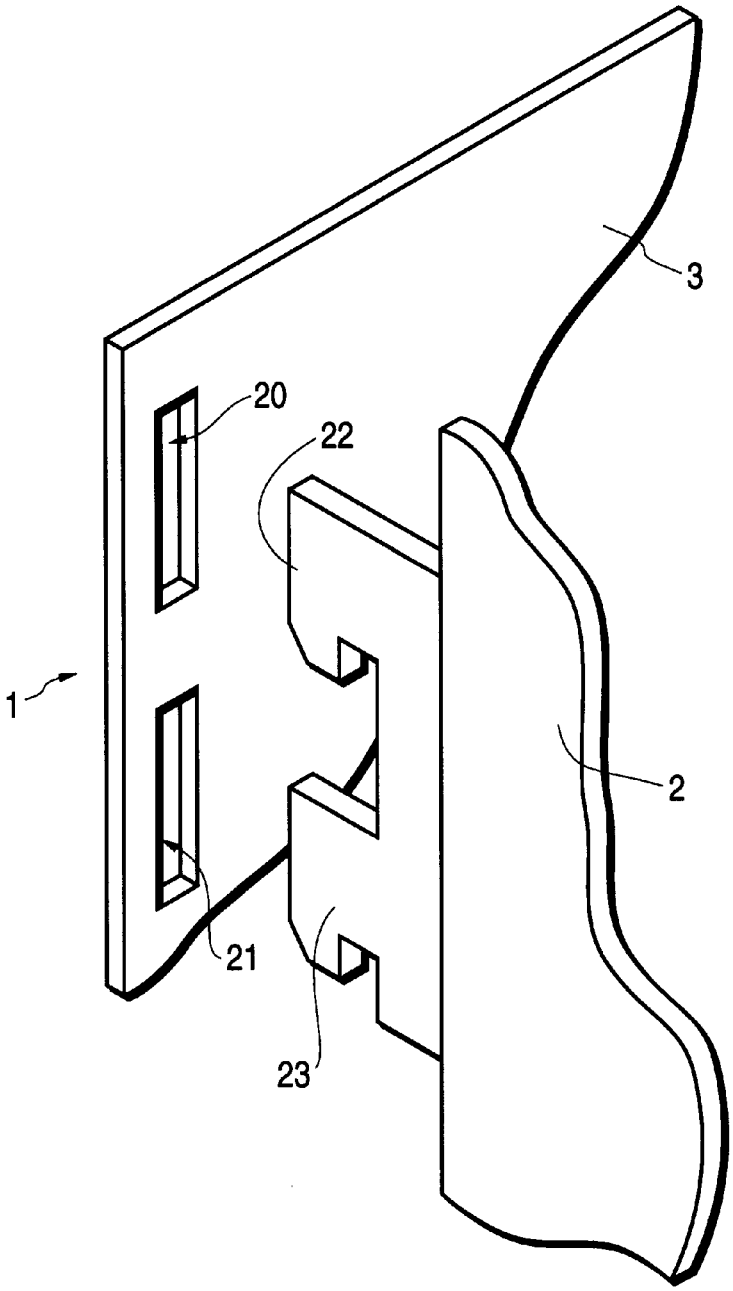
FIG. 2A is a expanded perspective view of Detail A—A of FIG. 2 in accordance with the present invention.

FIG. 2A shows an enlarged exploded view of detail A—A of FIG. 2 illustrating an embodiment wherein hinge 3 includes slots, shown generally as slots 20-21 which extend vertically within chassis 1. Corresponding hooks, shown generally as hooks 22-23 extend from door 2. Hooks 22-23 engage slots 20-21 so as to secure door 2 to chassis 1 such that door 2 can swing open and closed. Alternatively any of a number of different types of hinges could be used to secure door 2 to chassis 1 such that door 2 may swing open and closed.

Figure 3:
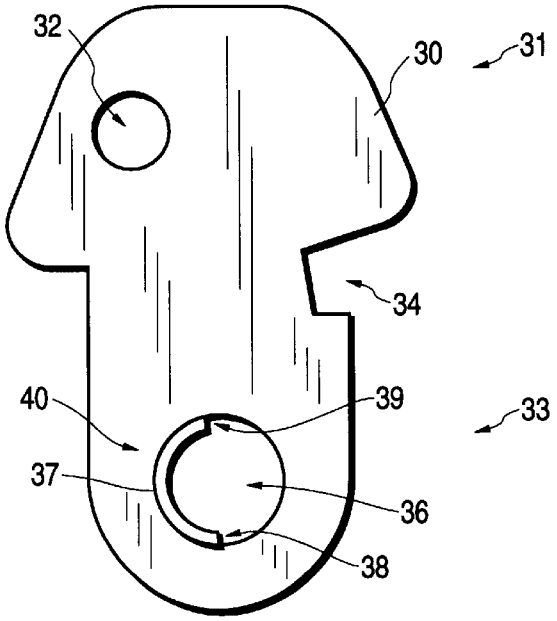
FIG. 3 is a front view of a tab in accordance with the present invention.

Tab 30 of FIG. 3 is shown to include a head region 31 and a body region 33. Lock opening 32 is a round opening that extends through head region 31 of tab 30. Tab 30 includes inset 34 which is formed in one side of tab 30 in body region 33 where body region 33 joins head region 31. Tab 30 also includes an attachment region for coupling tab 30 to another tab. In one embodiment, this attachment region, shown generally as attachment region 40 includes a pivot opening 36 and a pivot lock 37. Pivot lock 37 extends from one side of pivot opening 36. In the embodiment shown in FIG. 4, pivot lock 37 is shown to extend from tab 30. Pivot lock 37 of FIGS. 3–4 extends from lower end 38 to upper end 39 Pivot lock 37 extends in a circular arc having an outer circumference less than half of the circumference of pivot opening 36. In one embodiment, the outer diameter of pivot lock 37 extends in a circular arc having a diameter which is less than or equal to the diameter of pivot opening 36 in the region of pivot opening 36 which does not adjoin pivot lock 37. This allows a pivot lock of an identical tab to be inserted within pivot opening 36 of tab 30.

Figure 4:
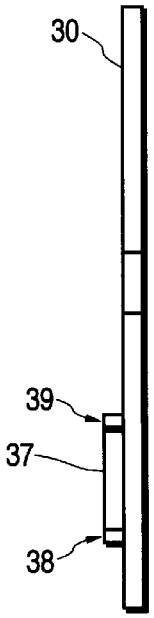
FIG. 4 is a side view of a tab in accordance with the present invention.

FIG. 4 shows pivot lock 37 to extend from one side of tab 30. Other than the extension of pivot lock 37 from one side of tab 30, tab 30 is flat. In one embodiment of the present invention, tab 30 is formed by stamping a sheet of metal so as to form a flat shape. The flat shape is then swaged by a die so as to form pivot lock 37. The simplicity of design of tab 30 makes tab 30 inexpensive to manufacture. Alternatively, tab 30 could be formed in a single stamping step when a die is used which both cuts out the shape of tab 30 and presses tab 30 such that pivot lock 37 is formed.

Figure 5:
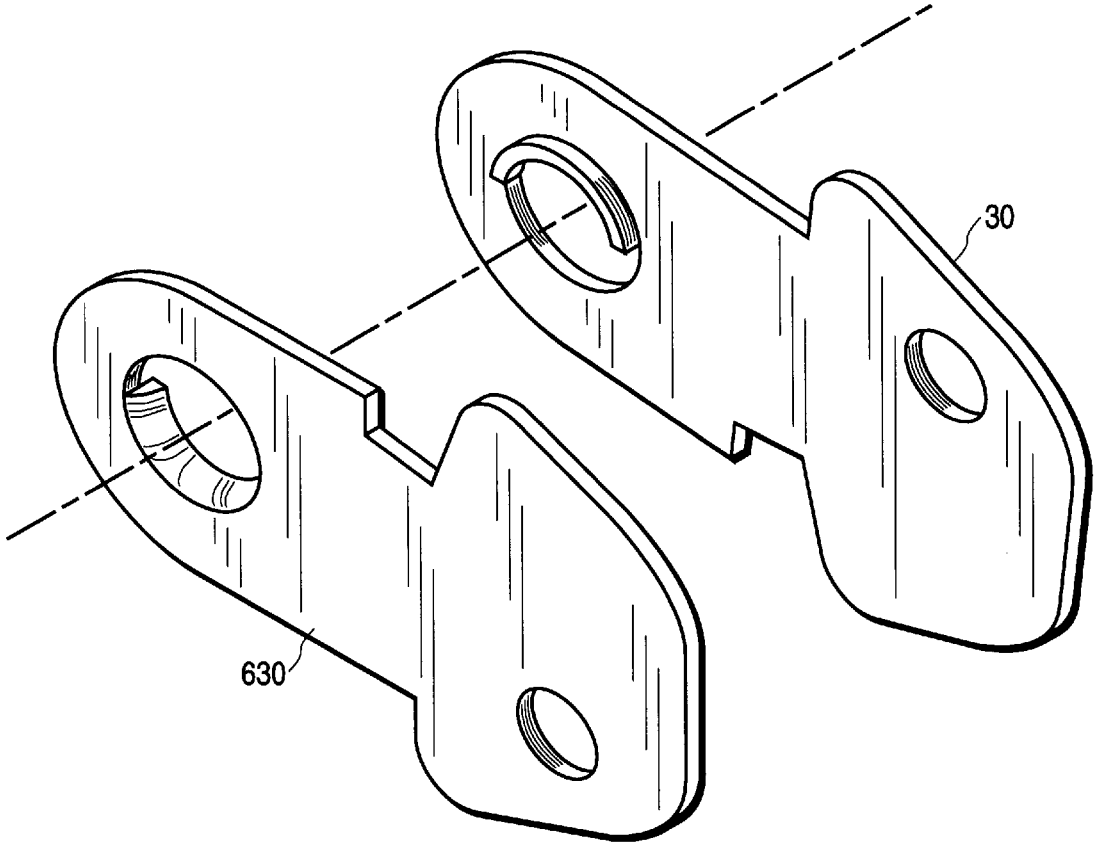
FIG. 5 is an exploded perspective view of a tab assembly in accordance with the present invention.

Two tabs are then mated together as shown in FIG. 5. Tab 630 is identical to tab 30. However, tab 630 is turned over such that the top side of tab 630 mates with top side tab 30. In one embodiment tab 30 and tab 630 are identical.

Figure 6:
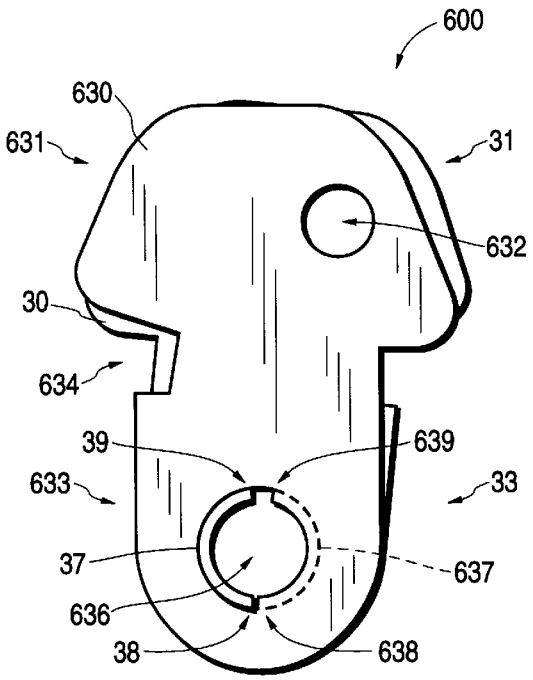
FIG. 6 is a front view of a tab assembly in the fully retracted position in accordance with the present invention.

FIG. 6 shows tab 30 and tab 630 to be mated so as to form tab assembly 600. Tab 630 includes lock opening 632, inset 634, pivot opening 636, and pivot lock 637. Pivot lock 637 is shown to include upper end 639 and lower end 638. Tab 30 and tab 630 are mated together such that pivot lock 37 of tab 30 extends through one side of pivot opening 636 of tab 630. Pivot lock 637 then extends through one side of pivot opening 36 of tab 30 such that tab 30 and tab 630 are pivotally connected.

In the embodiment shown in FIG. 6, tab 30 and tab 630 are pivoted into the closed position. In the closed position, lower end 38 of pivot lock 37 engages lower end 638 of pivot lock 637 so as to prevent further pivotal movement of tab assembly 600. In this position, a gap is formed in the top of pivot opening 36 and 636 between upper end 39 and upper end 639 such that tab 30 and tab 630 are free to pivot within a limited range as allowed by the separation between upper end 39 and upper end 639.

Figure 7:
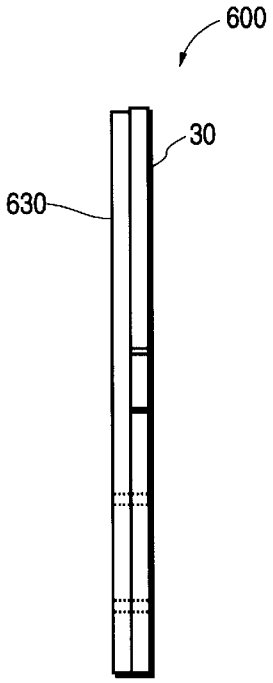
FIG. 7 is a side view of a tab assembly in the closed position in accordance with the sent invention.

FIG. 7 shows a side view of tab assembly 600. The side profile of tab assembly 600 is narrow enough so that tab assembly 600 may fit within slot 4 and slot 5 of FIGS. 1–2.

Figure 8:
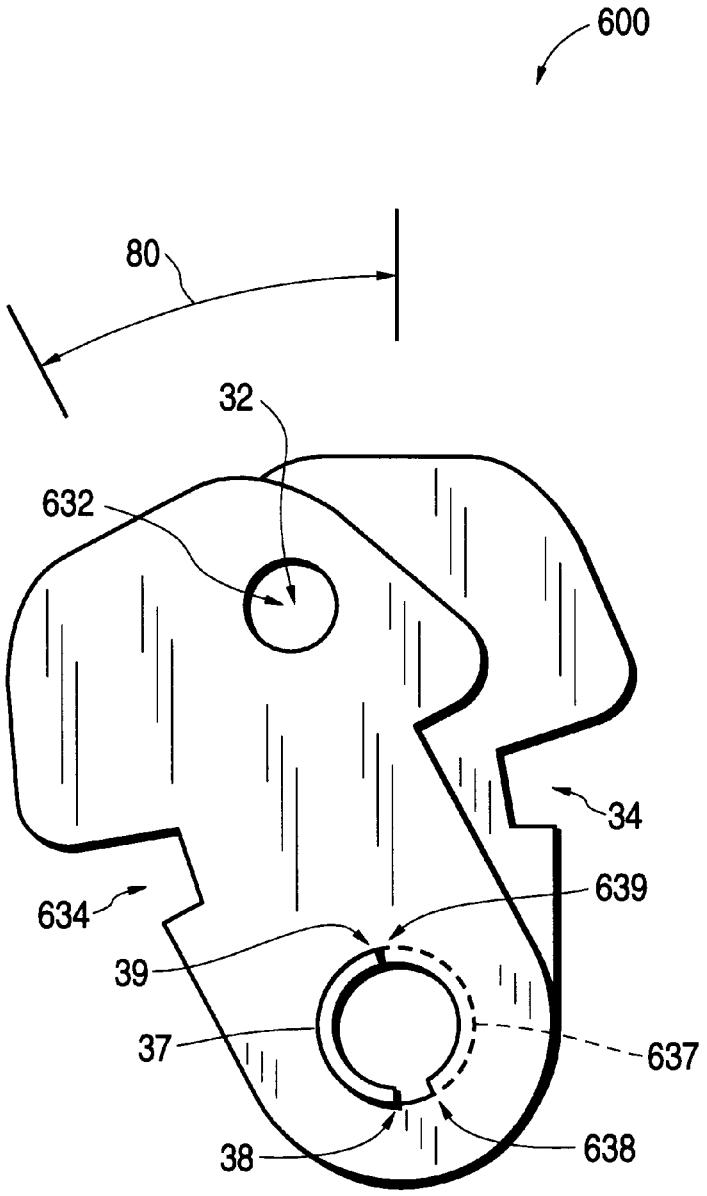
FIG. 8 is a front view of a tab assembly in the extended position in accordance with the present invention.

Tab 30 and tab 630 may pivot laterally with respect to each other as shown by arrow 80 of FIG. 8 so as to move tab assembly 600 into the extended position. In the extended position, upper end 39 of pivot lock 37 contacts upper end 639 of pivot lock 637 so as to prevent further movement. Thus, only movement between the closed position and the extended position is allowed.

Figure 9:
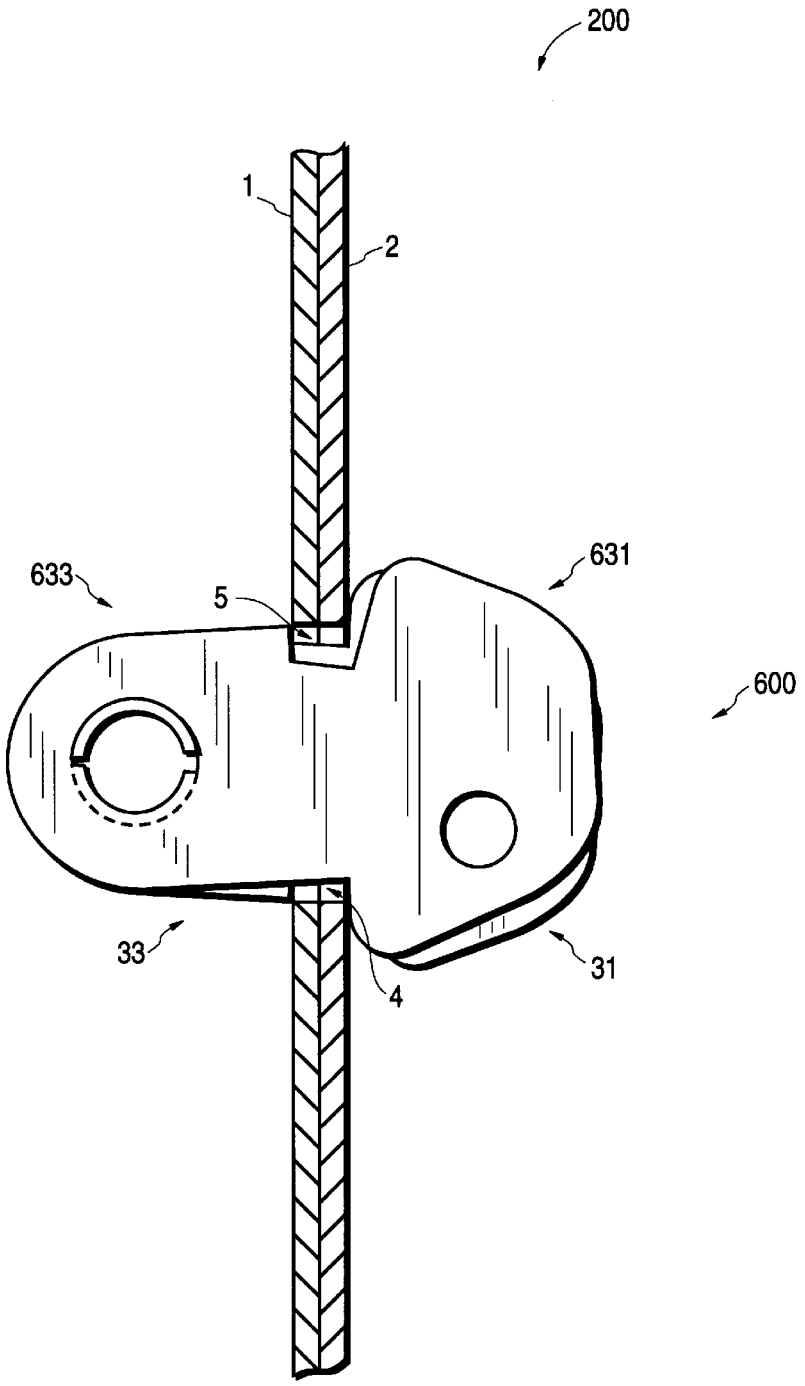
FIG. 9 is a cut away side view of a computer having a tab assembly disposed therein which is in the closed position in accordance with the present invention.

In operation, tab assembly 600 of latch assembly 200 is pivoted into the closed position as shown in FIG. 9. Tab assembly 600 is then inserted into slot 4 and slot 5. In the closed position body 30 and body 630 are aligned such that tab assembly 600 fits within slot 4 and slot 5. The width of head region 31 and head region 631 is greater than the length of slots 4-5. Thus, tab assembly 600 may only be inserted into slots 4-5 until such time that head region 31 and head region 631 contact the outer surface of door 2. In the closed position, tab assembly 600 may also be easily removed from slots 4-5.

Figure 10:
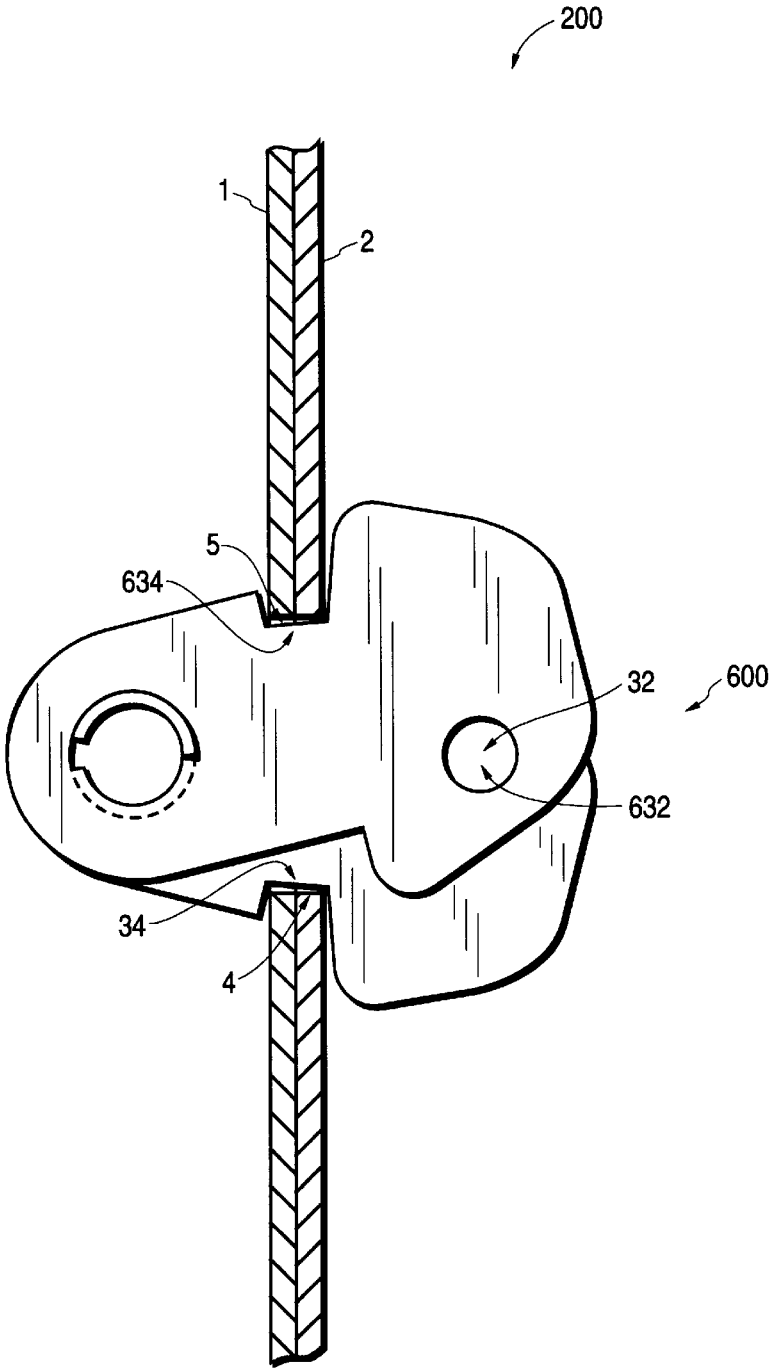
FIG. 10 is a cut away side view of a computer having a tab assembly disposed therein which is in the extended position in accordance with the present invention.
Figure 11:
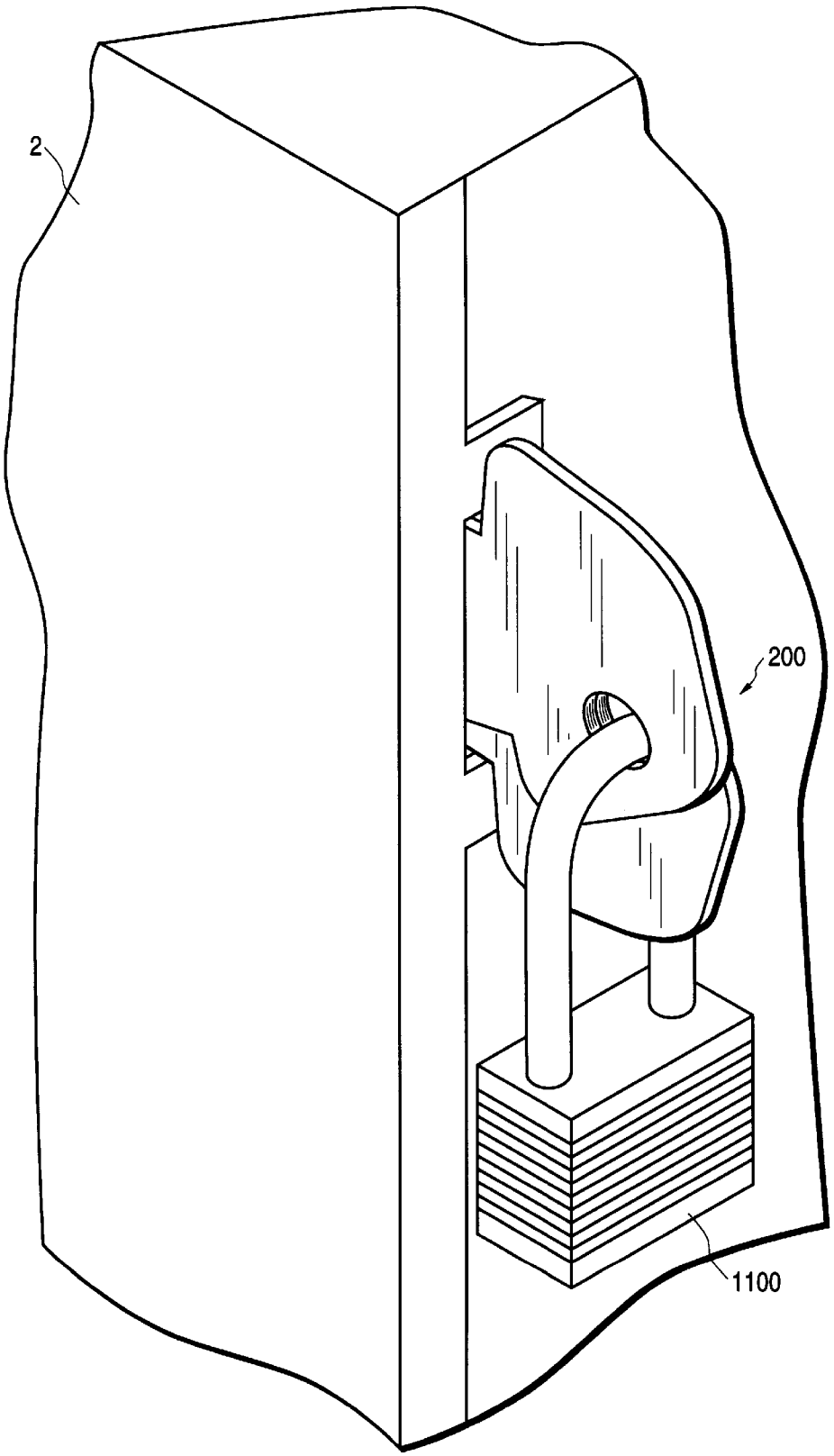
FIG. 11 is a perspective view of a computer having a tab assembly disposed therein which is locked in the extended position by a padlock in accordance with the present invention.

When tab assembly 600 is extended laterally into the extended position when tab assembly 600 is disposed within slots 4-5, inset 34 and inset 634 lockingly engage the surfaces of chassis 1 and door 2 as is shown in FIG. 10 so as to secure door 2 to chassis 1. In the extended position, lock opening 32 and lock opening 632 align with each other so as to form an opening which extends through tab assembly 600. In this position, opening 32 and opening 632 are adapted to receive a lock such as lock 1100 shown in FIG. 11. Once a lock is inserted within lock opening 32 and lock opening 632 of FIG. 10, tab assembly 600 is restrained such that it remains in the extended position until such time that lock 1100 of FIG. 11 is removed. In one embodiment, lock 1100 is a conventional padlock which may be a keyed padlock or a combination padlock. Alternatively, other locks such as bar-locks, rigid cable-locks, etc. may also be used to lock tab assembly 600 in the extended position. In addition, if a lock is not required, a pin may be inserted into lock openings 32, 632 to hold tab assembly 600 in the extended position so as to latch door 2 to chassis 1.

Forming slots 4-5 within door 2 and chassis 1 of the embodiments shown in FIGS. 1–11 is easy and inexpensive. In addition, the use of a slot for locking door 2 to chassis 1 eliminates expensive flange formation and/or attachment steps as is required by prior art systems which use corresponding flanges on the door and on the chassis to lock the door to the chassis. Moreover, since tab assembly 600 is formed using two of an identical part, only one part needs to be manufactured. This saves manufacturing time and expense. In addition, conventional padlocks are inexpensive. Thus, the latching system of the present invention allows for inexpensively latching and locking a door to a chassis.

Though the tab assembly of the present invention is shown in FIGS. 1–11 to include an attachment region which includes a pivot opening and a pivot lock, other attachment mechanisms could also be used to attach tabs such that the tabs may extend laterally. Other attachment mechanisms which could be used include brads, screws, nuts, bolts, etc.

Door 2 shown in FIGS. 1–11 is disposed on one side of chassis 1. The latching mechanism of the present invention is also well suited for securing doors located on the rear, front, top, or bottom of chassis 1. In addition, multiple doors may be latched and/or locked to a single chassis.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents.

We claim:

1. A tab assembly comprising:

a first tab having a first opening proximate a first end of said first tab and a first attachment region proximate a second end of said first tab, said first tab including a first inset disposed between said first opening and said first attachment region; and a second tab having a second opening proximate a first end of said second tab and a second attachment region proximate a second end of said second tab, said second tab including a second inset disposed between said second opening and said second attachment region, said first tab and said second tab being identical and adapted to be mated together at said first attachment region and said second attachment region so as to hold a door to a chassis for locking a computer housing at said insets.

2. A housing for a computer comprising:

a chassis having a first slot formed therein;

a door moveably coupled to said chassis such that said door is adapted to move from a closed position to an open position, said door having a second slot formed therein, said second slot aligned such that, when said door is in said closed position, said first slot is aligned with said second slot;

a first tab having a first opening proximate a first end of said first tab adapted to receive a lock and a first attachment region proximate a second end of said first tab, said first tab including a first inset having two side walls and an end wall, said first inset disposed between said first opening and said first attachment region; and a second tab having a second opening proximate a first end of said second tab adapted to receive a lock and a second attachment region proximate a second end of said second tab, said second tab including a second inset having two side walls and an end wall, said second inset disposed between said second opening and said second attachment region, said first tab and said second tab identical and adapted to be mated together at said first attachment region and inserted into said first slot and said second slot, said first inset and said second inset adapted to capture said door and said chassis so as to hold said door to said chassis for locking said chassis to said door.

3. The tab assembly of claim 1 wherein said first attachment region includes a first extended region that extends from said first tab and wherein said second attachment region includes a second extended region that extends from said second tab.

4. The tab assembly of claim 3 wherein said first attachment region further comprises an opening adapted to receive said second extended region and wherein said second attachment region includes an opening adapted to receive said first extended region.

5. A method of locking two or more walls of a computer housing together, said method comprising:

providing a first tab having a first opening proximate a first end of said first tab and a first attachment region proximate a second end of said first tab and a first inset disposed between said first opening and said first attachment region;

providing a second tab having a second opening proximate a first end of said second tab and a second attachment region proximate a second end of said second tab and a second inset disposed between said second opening and said second attachment region;

forming a tab assembly by coupling said first attachment region to said second attachment region;

inserting said tab assembly into a slot in said two or more walls;

extending said first tab and said second tab such that said first inset and said second inset capture said two or more walls so as to hold said two or more walls together; and inserting a lock into said first opening and said second opening.

* * * * *